US005170589A

United States Patent [19]

Harinen et al.

[11] Patent Number: 5,170,589

[45] Date of Patent: Dec. 15, 1992

[54] METHOD FOR RECONDITIONING OF THE SEALING FACE ON A DRYING CYLINDER OF A PAPER MACHINE AND DEVICE FOR RECONDITIONING OF THE SEALING FACE

[75] Inventors: Pekka Harinen, Jyväskylä; Kari Rajala, Niemisjärvi, both of Finland

[73] Assignee: Valmet Paper Machinery Inc., Finland

[21] Appl. No.: 615,420

[22] Filed: Nov. 19, 1990

[30] Foreign Application Priority Data

Nov. 28, 1989 [FI] Finland ..... 895695

[51] Int. Cl.[5] ..... B24B 19/00

[52] U.S. Cl. ..... 51/241 B; 51/241 S

[58] Field of Search ..... 51/241 R, 241 S, 241 B, 51/241 VS, 241 A, 245, 281 R, 291

[56] References Cited

U.S. PATENT DOCUMENTS 2,809,483 10/1957 Wierzbicki ..... 51/241 VS

FOREIGN PATENT DOCUMENTS 0618662 9/1935 Fed. Rep. of Germany ... 51/241 A
3712608 10/1988 Fed. Rep. of Germany ... 51/241 VS
3814189 11/1989 Fed. Rep. of Germany ... 51/241 VS
0185362 7/1990 Japan ..... 51/241 VS

*Primary Examiner*—Roscoe V. Parker
*Attorney, Agent, or Firm*—Steinberg & Raskin

[57] ABSTRACT

A method for reconditioning of the sealing face (11) at the opening of the manhole (10) of a drying cylinder (K) of a paper machine when the cylinder (K) is in its operating position in the paper machine. In the method a separate frame part (13) is attached to the cylinder end. The frame part (13) comprises guides (15*a*, 15*b*), along which a machining unit (16) is displaced which is fitted to machine the sealing faces. Also disclosed is a device for use in the method.

10 Claims, 3 Drawing Sheets

METHOD FOR RECONDITIONING OF THE SEALING FACE ON A DRYING CYLINDER OF A PAPER MACHINE AND DEVICE FOR RECONDITIONING OF THE SEALING FACE

BACKGROUND OF THE INVENTION

The invention concerns a method for reconditioning of the sealing face on a drying cylinder of a paper machine and an apparatus for reconditioning of the sealing face.

In ageing paper machines, a problem has been that the sealing faces of the manholes at the drying cylinders become corroded such that it has not been possible to guarantee good sealing by means of the currently available sealing materials. The reconditioning of the sealing face placed at the end of a cylinder has proven to be particularly laborious. The reconditioning of the manhole of the door itself is no problem, because it can be carried easily to the machine tool. Instead, the conditioning of the sealing face on the roll end, to be fitted against the door, has caused problems. Disassembly of the construction has required a considerable amount of time and, thus, the cost of reconditioning has become high as a paper machine comprises a number of seal faces to be reconditioned.

SUMMARY OF THE INVENTION

Thus, an object of the invention has been to provide an entirely novel device and method for reconditioning of the sealing face of a manhole while the drying cylinder is in its place in the paper machine. According to the invention, a low weight portable, apparatus is provided which is supported by its frame on the structure of the end flange of the roll and in which method the device comprises guides which comply with the shaft of the manhole opening and along which the reconditioning device is passed.

The method in accordance with the invention for reconditioning of a sealing face in a paper machine is mainly characterized in that in the method a separate frame member is attached to the cylinder end, said frame part comprising guides, and that in the method a machining unit is displaced along the guides, said machining unit being fitted to machine the sealing faces.

The apparatus in accordance with the invention for reconditioning of the sealing face is mainly characterized in that the apparatus comprises a frame part to be attached to the end of the cylinder, said frame part including guides, and that the apparatus comprises a machining unit moved along the guides, which unit includes a motor that rotates the tool.

BRIEF DESCRIPTION OF THE DRAWINGS

The invention will be described in the following with reference to some preferred embodiments of the invention illustrated in the figures in the accompanying drawings, the invention being, however, not confined to said embodiments alone.

DESCRIPTION OF THE PREFERRED EMBODIMENTS

Figure 1:
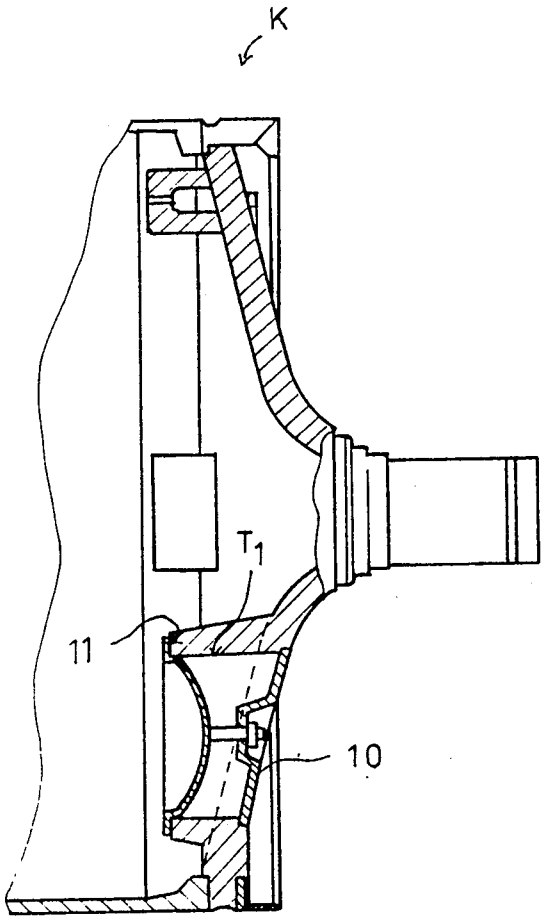
FIG. 1 is a sectional elevational view of a drying cylinder of a paper machine.

FIG. 1 shows a drying cylinder K of a paper machine. The manhole passing into the interior of the drying cylinder K of a paper machine is denoted with the reference numeral 10. The sealing faces 11 are fitted so that they can be reconditioned by means of the device in accordance with the invention, which device will be described in more detail in the following and which device is attached to the inner faces $T_1$ of the opening of the manhole 10.

Figure 2:
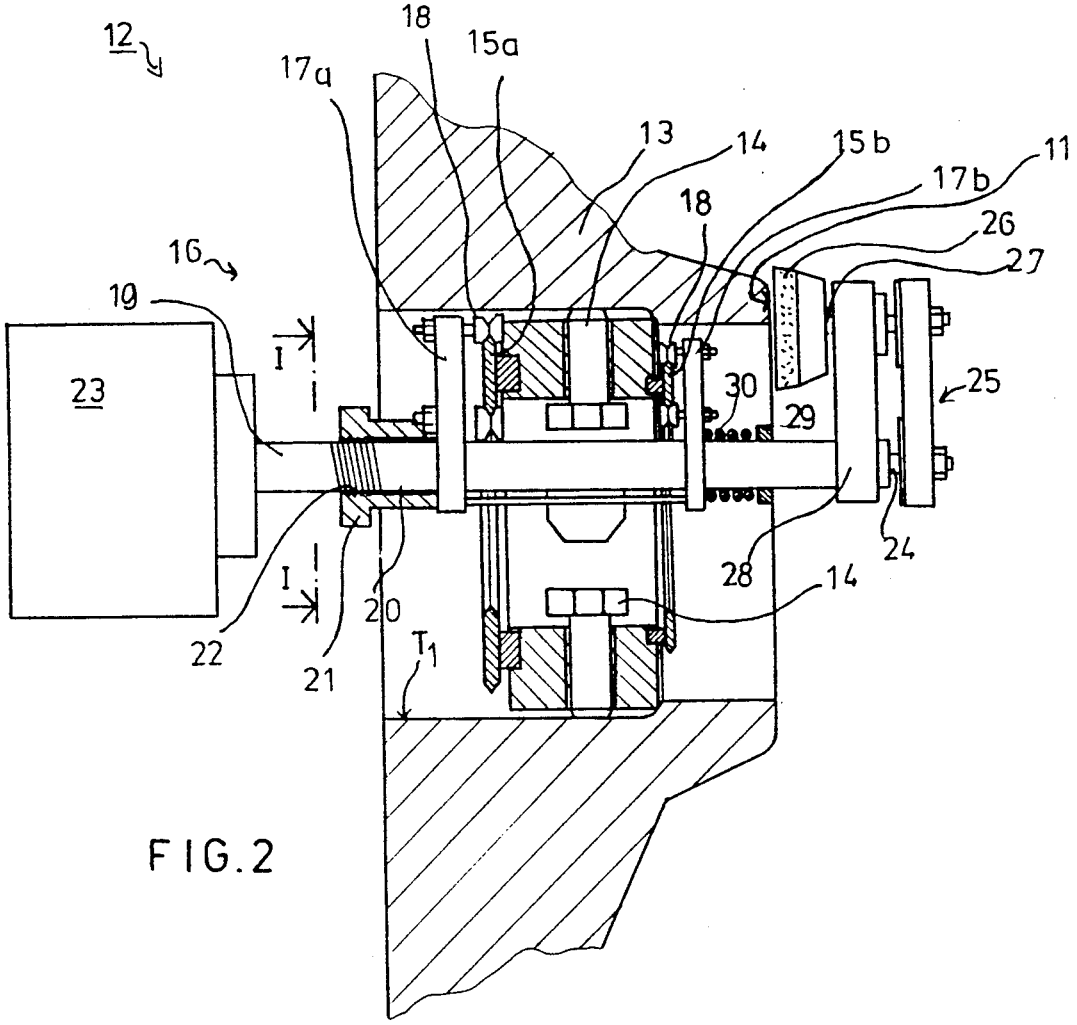
FIG. 2 is a partially sectional view of an apparatus in accordance with the invention as installed at the end of the cylinder.

FIG. 2 is a sectional view of a device in accordance with the invention. The reconditioning device 12 includes a frame member 13, which is attached to the cylinder end by means of locking pins 14, preferably screws. The frame 13 includes guide members 15*a* and 15*b* of oval shape integral to the frame member.

Figure 3:
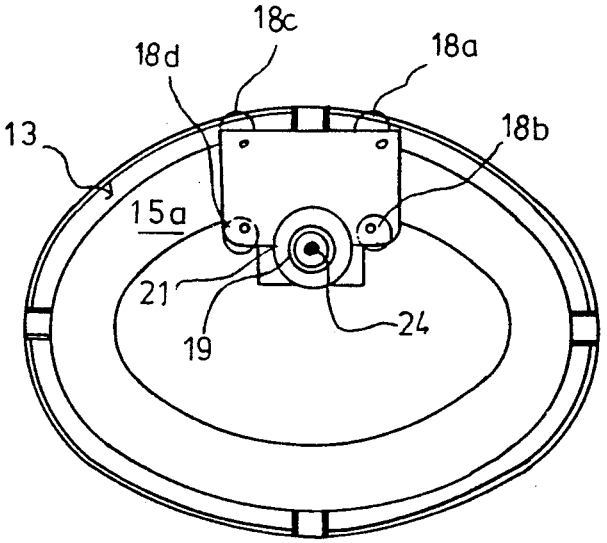
FIG. 3 is a sectional view taken along the line I—I in FIG. 2.

The apparatus includes a displaceable machining unit 16 to be passed along the guides. The machining unit 16 comprises guide sledges 17*a* and 17*b*, to which rollers 18*a*, 18*b*, 18*c*, 18*d* are attached respectively to both sledge portions 17*a* and 17*b* (FIG. 3). The rollers 18*a* and 18*b*; 18*c* and 18*d*, placed one above the other, are fitted to be supported on the guide part 15*a* so that they are in engagement with opposite sides of the guide part. In a corresponding way, the rollers 18 are placed in engagement with the second guide part 15*b*. The sledges 17*a* and 17*b* themselves are connected to the shaft 19 of motor 23 so that the sledges can slide on the shaft in the direction of the central axis x of the shaft 19. At its end placed at the side of the motor 23, the shaft 19 has a threading 20 on its outer face, to which threading the nut 21 is attached, whose end face is supported on the sledge 17*a*. The threading 22 of the nut 21 is compatible with the threading 20 on the shaft 19. The motor 23, preferably a pneumatic motor, is placed at the end of the shaft 19. The output shaft 24 of the motor 23 passes through the shaft 19, and its end is coupled with the drive shaft 27 of the machining tool 26 by means of a belt transmission 25. Also, the shaft 27 is supported on the shaft 19 by means of an auxiliary frame 28.

Figure 4:
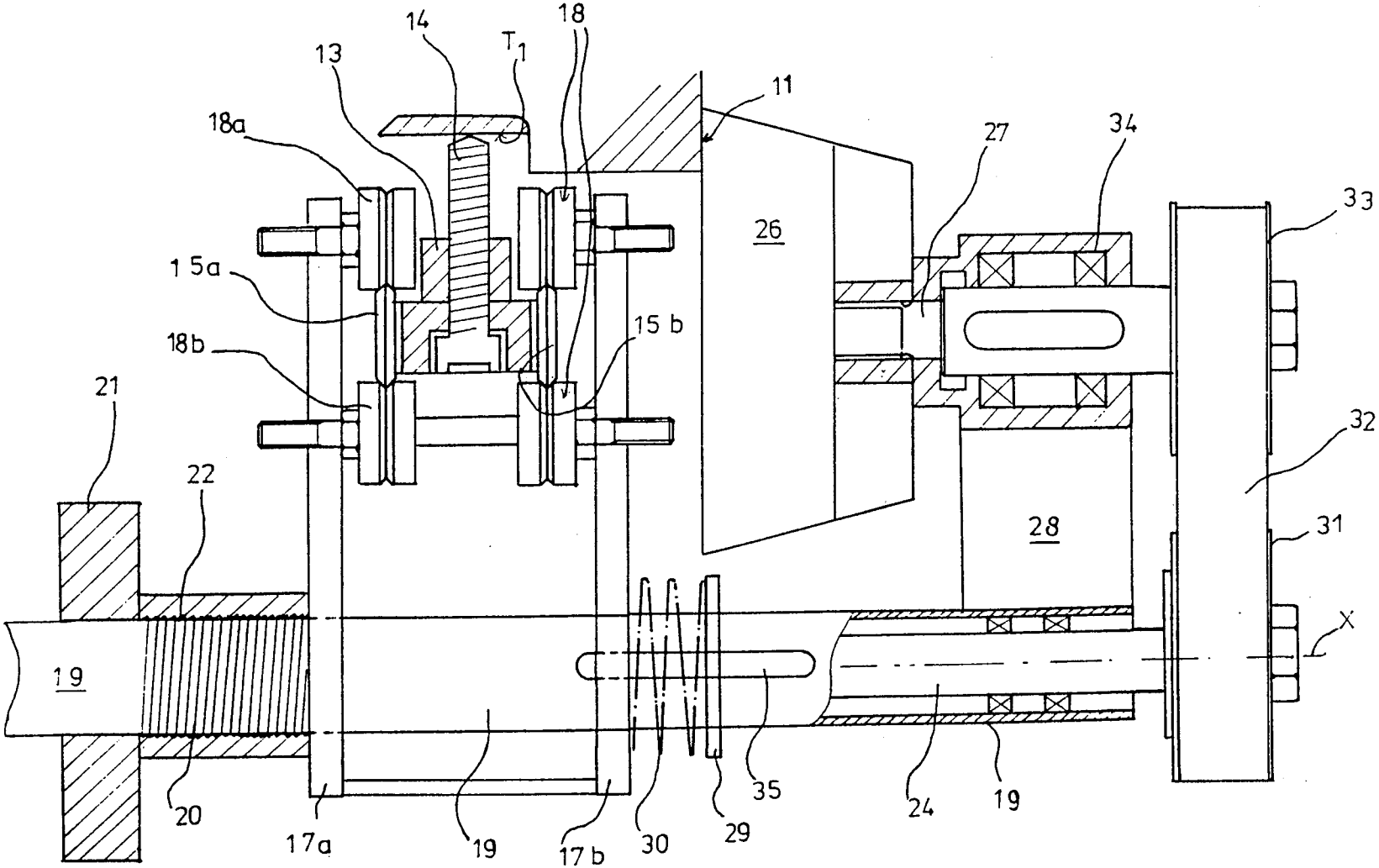
FIG. 4 is a more detailed partial illustration of the embodiment of FIG. 2.

A disk 29 is affixed permanently to the shaft 19, and a compression spring 30 is fitted between the disk 29 and the outer face of the sledge 17*b*. Thus, the position of the shaft 19 and of the shaft 24 placed in its interior is adjustable by rotating the nut 21 in the threading 20 on the shaft 19 against the spring 30 force. Rotation of the shaft 19 relative to the sledge 17*a*, 17*b* is prevented by means of a key between the shaft 19 and the sledge 17*b* (FIG. 4). On the contrary, the key permits movement of the shaft 19 in the direction of the normal of the face to be machined. Thus, the machining tool can be displaced in the direction of the normal of the face when the machining proceeds. FIG. 2 shows the grinding disk at the stage before machining of the face 11. By rotating the nut 21, the grinding disk 26 can be brought into contact with the face 11 to be machined.

The motor 23 itself is displaced manually along the guides 15*a* and 15*b* of oval shape.

FIG. 3 is a sectional view taken along the line I—I in FIG. 2. In the Figure, the guide 15*a* of oval shape is seen, along which the equipment is displaced manually.

From the Figure it is seen further that the shaft 24 which rotates the tool runs inside the shaft 19.

FIG. 4 is a more detailed partial illustration of an embodiment of the invention similar to that shown in FIG. 2. The motor 23 is not shown in the illustration in part. From the shaft 24 the movement of rotation is transferred to the belt pulley 31 and from the belt pulley 31, by the intermediate of the belt 32, to the driven belt pulley 33, which is adapted to rotate the shaft 27 of the grinding disk 26. As is shown in the Figure, the shaft 27 of the grinding disk 26 is mounted on an auxiliary frame 28 by bearing means 34. The shaft 19 is fixed to the sledges 17*a* and 17*b* so that rotation between the parts is prevented by mean of the key 35.

Figure 5:
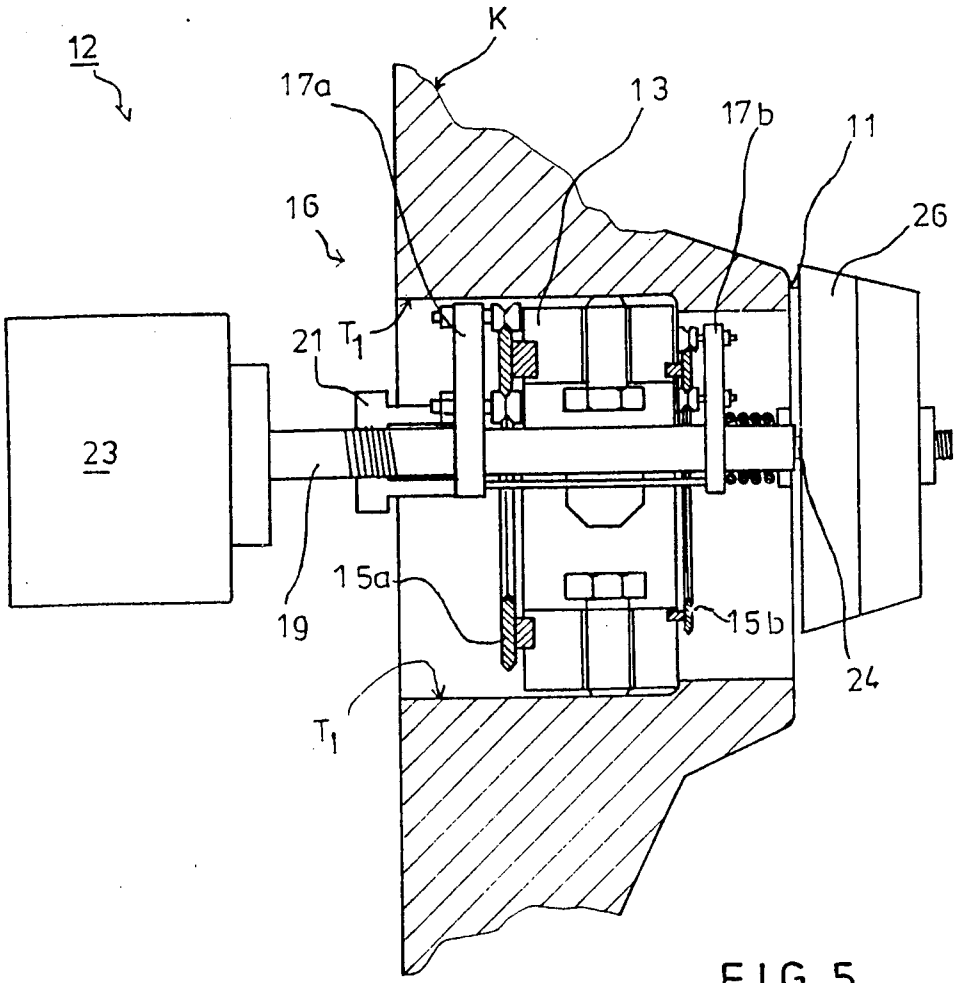
FIG. 5 shows a second preferred embodiment of the apparatus of the invention.

FIG. 5 shows a second embodiment of the device in accordance with the invention, in which the motor 23 is fitted to rotate the drive shaft 24 fitted inside the shaft 19, the grinding disk 26, preferably a cup wheel, being connected directly to said shaft 24. The cup wheel 256 is in a position from which it is fed into contact with the face 11 to be machined by rotating the nut 21.

Although preferred embodiments of the subject invention have been shown herein, it is submitted that numerous other embodiments within the scope of the appended claims will readily occur to those skilled in the art.

What is claimed is:

1. An apparatus for reconditioning the sealing face of a drying cylinder of a paper machine comprising:

a frame member attachable to an end of said drying cylinder and comprising a plurality of guide members integral thereto;

a machining unit comprising a tool for machining said face, said machining unit being connected to said frame member so as to be movable along said guide members for contacting said tool with said sealing face;

a drive motor having an output shaft connected to said tool such that rotational movement of said output shaft is transmitted to said tool;

said machining unit comprising a hollow shaft connected to said output shaft of said drive motor and displaceable in a direction perpendicular to said sealing face;

a plurality of guide sledges connected to said hollow shaft;

a plurality of rollers attached to said guide sledges, said rollers being engaged to respective ones of said plurality of guide members and said engaged rollers being displaceable along said respective guide members; and one or more locking members for attaching said frame members to said cylinder.

2. The apparatus of claim 1, further comprising a nut having internal threading, said nut being mounted on said shaft of said machining unit such that said internal threading engages with external threading on said shaft of said machining unit and such that rotation of said nut in a certain direction displaces said shaft and said machine tool towards said sealing face of said cylinder.

3. The apparatus of claim 1, further comprising a machine tool drive shaft directly connected to said shaft of said machine unit to receive drive movement therefrom.

4. The apparatus of claim 3, further comprising a belt pulley connected to one end of said shaft of said machine unit, a belt connected to and driven by said belt pulley, and a driven wheel connected to said belt and to said machine tool shaft.

5. The apparatus of claim 2, further comprising a spring mounted on said shaft of said machine unit and opposing movement of said shaft of said machining unit caused by rotation of said nut.

6. An apparatus for reconditioning of the sealing face of a drying cylinder of a paper machine comprising:

a frame member attachable to an end of said drying cylinder and comprising a plurality of guide members integral thereto;

a machining unit comprising a tool for machining said face, said machining unit being connected to said frame member so as to be movable along said guide members for contacting said tool with said sealing face; and a drive motor having an output shaft connected to said tool such that rotational movement of said output shaft is transmitted to said tool;

said machining unit further comprising a hollow shaft connected to said output shaft of said motor and displaceable in a direction perpendicular to said sealing face; a plurality of guide sledges connected to said hollow shaft, a plurality of rollers attached to said guide sledges, said rollers being engaged to respective ones of said plurality of guide members and said engaged rollers being displaceable along said respective guide members.

7. The apparatus of claim 6, further comprising a nut having internal threading, said nut being mounted on said shaft of said machining unit such that said internal threading engages with external threading on said shaft of said machining unit and such that rotation of said nut in a certain direction displaces said shaft and said machine tool towards said sealing face of said cylinder.

8. The apparatus of claim 6, further comprising a machine tool drive shaft directly connected to said shaft of said machine unit to receive drive movement therefrom.

9. The apparatus of claim 8, further comprising a belt pulley connected to one end of said shaft of said drive unit, a belt connected to and driven by said belt pulley, and a driven wheel connected to said belt and to said machine tool shaft.

10. The apparatus of claim 7, further comprising a spring mounted on said shaft of said machining unit and opposing movement of said shaft of said machinery unit caused by rotation of said nut.

* * * * *